United States Patent [19]

Kowach et al.

[11] 4,036,164

[45] July 19, 1977

[54] TWIN CONTROLLABLE PITCH PROPELLERS OPERATED FROM SINGLE PRIME MOVER

[75] Inventors: Ronald A. Kowach; William I. Rowen, both of Schenectady, N.Y.

[73] Assignee: General Electric Company, Schenectady, N.Y.

[21] Appl. No.: 719,839

[22] Filed: Sept. 2, 1976

[51] Int. Cl.[2] ..... B63H 3/10

[52] U.S. Cl. ..... 115/37; 416/30

[58] Field of Search ..... 115/34 R, 34 A, 37; 416/25, 27, 30

[56] References Cited

U.S. PATENT DOCUMENTS

| | | | |
|---|---|---|---|
| 3,110,348 | 11/1963 | Greiner | 416/27 |
| 3,588,272 | 6/1971 | Lindahl et al. | 416/30 |
| 3,704,077 | 11/1972 | Meyers et al. | 416/30 |
| 3,824,380 | 7/1974 | Gross | 115/34 R |

*Primary Examiner*—George E. A. Halvosa
*Assistant Examiner*—Stuart M. Goldstein
*Attorney, Agent, or Firm*—Erwin F. Berrier, Jr.

[57] ABSTRACT

The invention relates to improved control systems for controllable pitch propellers of a twin screw vessel driven by a single prime mover operating at a predetermined rotational speed while the vessel is in the at sea mode, with provisions for maintaining the total load of said propellers upon the prime mover substantially constant under varying at sea conditions. A further element of the invention permits the transition of the control system to and from the maneuvering mode to the at sea mode under substantially smooth operating conditions of speed and power.

6 Claims, 2 Drawing Figures

TWIN CONTROLLABLE PITCH PROPELLERS OPERATED FROM SINGLE PRIME MOVER

FIELD OF THE INVENTION

This invention relates to an improved control system for controllable pitch propellers as utilized on twin screw vessels or ships and driven by a prime mover, such as a gas turbine power plant. The invention herein is more particularly directed toward a new and improved control system for a propulsion system for a vessel which utilizes a single prime mover operating at a constant rotational speed for powering the propellers and the auxiliary electrical power generator of the vessel when the vessel is operating in an at sea mode as distinguished from a maneuvering or docking mode.

DESCRIPTION OF THE PRIOR ART

It has been usual for a vessel such as a ship to utilize a twin propeller propulsion system for propelling the vessel through the water. In such vessels utilizing a twin propeller propulsion system, it has been customary to use separate prime movers for each of the propellers. The use of individual prime movers permitted the propellers to be operated at individual speeds and powers, and contributed to the maneuverability of the vessel. The foregoing type of vessel similarly required an electric power generation apparatus which utilized an additional prime mover for auxiliary power.

It can readily be seen from the foregoing that a multiplicity of prime movers would be required for a vessel of the type herein referred to. The need for the multiplicity of prime movers resulted basically from the fact that it is desirable to operate each propeller independently at a desired speed and/or pitch and to operate a prime mover for electrical power for the vessel at a constant speed which would assure a predetermined 50 or 60 hertz electric source of supply. It has thus been customary in the past to utilize a plurality of prime movers for powering the propulsion and auxiliary electrical systems of twin screw vessels.

OBJECTS OF THE INVENTION

It is an object of the present invention to provide a new and improved control system for use with a ship propulsion system wherein a single prime mover is utilized to drive the propellers of a twin screw ship or vessel and wherein the same prime mover may simultaneously be utilized to drive an electrical power generation system of the ship at a fixed frequency while the ship is operated in the at sea mode.

It is a further object of the invention to provide a new and improved control system for use with a ship propulsion system wherein a single prime mover is utilized to drive the propellers of a twin screw ship or vessel and the rotational speed of the prime mover is maintained constant under varying propulsion load conditions while the ship is operating in the at sea mode.

It is another object of the invention to provide a new and improved control system for use with a ship propulsion system wherein a prime mover is utilized to drive two propellers and an electrical power generating system of a vessel, and wherein the transition from a maneuvering mode of operation of the vessel to an at sea going mode of operating of the vessel is accomplished with a minimum of disturbance.

It is another object of the invention to provide a new and improved control system which permits the use of a single prime mover of a given capacity to provide for the power needs of a vessel of the twin screw type in contrast to the use of multiple smaller prime movers currently utilized for such power needs.

Other objects and advantages of the present invention will be obvious to those skilled in the art from a reading of the specification when taken with the drawings herein.

SUMMARY OF THE INVENTION

In brief, the invention is practiced in one form, by utilizing a first seqment of the new and improved control system during a first period of operation of a twin screw ship or vessel hereinafter designated as a first mode or at sea mode of operation, and utilizing a second segment of the new and improved control system during a second period of operation of the vessel hereinafter designated as a second mode or maneuvering mode of operation. Provisions are made in the new and improved control system for transition from the maneuvering mode to the at sea mode without the intervention of undesirable transients.

In the at sea mode, port and starboard quarter-square multipliers of the control system of the invention are each supplied with input signals from port and starboard propulsion levers (under control of an operator) and from an isochronous governor. The port and starboard quarter-square multipliers each provide output control signals, representative of the combined input signals at each, to a part and starboard servo, respectively, to control the appropriate propeller pitch and to modify the propeller pitch responsive to changes in load conditions upon the propellers, and thus maintain a constant system rotational speed.

In the maneuvering mode, control of the pitch of the propellers is under direct control of the part and starboard propulsion levers. The port and starboard quarter-square multipliers track the controls in the maneuvering mode to permit transfer from the maneuvering mode to the at sea mode without the intervention of undesirble transients.

THE DRAWINGS

DETAILED DESCRIPTION

Figure 1:
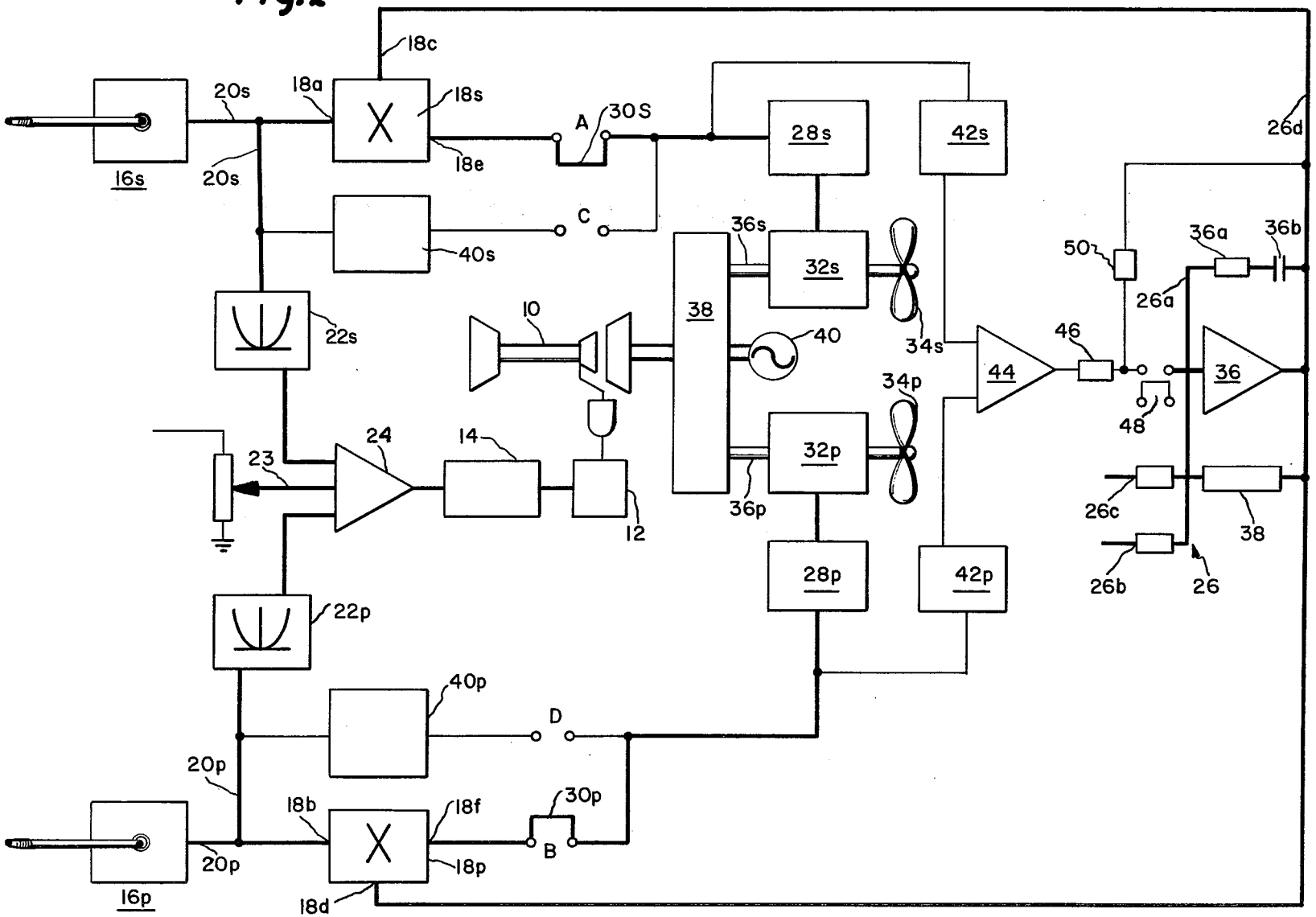
FIG. 1 is a diagram of the circuit of the invention for use with a prime mover of a vessel operating in the at sea mode, with heavy lines indicating the components active in said mode.

Referring to FIG. 1 of the drawing, there is shown a control system for operation of a prime mover such as a gas turbine 10 in the at sea mode or first mode. The prime mover or gas turbine 10 is fed fuel by means of a fuel system 12, which fuel system 12 is responsive to commands from a turbine control system 14. Such fuel control systems are well known in the art. One such fuel control system is found in U.S. Pat. No. 3,639,076 issued Feb. 1, 1972 to William I. Rowen and assigned to applicant's assignee. It is contemplated that the prime mover 10, will operate at a constant speed, in the at sea mode, in accordance with the rotational speed required to drive an electrical generator to obtain power at a predetermined frequency.

To the extent portions of the control system related to starboard and port sections of the system are mirror images of one another, like reference numerals with the designation of S for starboard and P for port are utilized herein.

The manual starboard control 16S and the port control 16P each provide means for developing a signal representative of a command inserted by an operator. Such commands may each be varied between full pitch in either direction and zero pitch. Manual starboard control 16S and manual port control 16P are each individually connected respectively to first inputs **18*a* and 18*b* of quarter-square electronic multiplier 18S or 18P, respectively, through lines 20S and 20P, and to two quadrant cubic function generators 22S and 22P**.

The outputs of cubic function generators 22S and 22P, which form part of the fuel system control circuit are fed to an amplifier 24 wherein the outputs of said cubic function generators 22S and 22P are summed, modified by an offset signal applied at terminal 23, and amplified to provide a power reference signal to the turbine control system 14 as is well known in the art.

In the at sea mode, the circuit of the invention utilizes an isochronous governor 26 which provides for the maintenance of a constant speed of the prime mover and connected system comprising the transmission, propellers and auxiliary generator, by varying the load on the propellers by varying the pitch.

The isochronous governor 26 comprises interconnected components including an operational amplifier 36 connected to an input **26*a* and an output 26*d* of the isochronous governor. A resistor 36*a* and capacitor 36*b* are connected in series and between the input 26*a* and output 26*b* of the isochronous governor 26 and thus between the input and output of amplifier 36. A limit circuit 38 is also connected between the input 26*a* and output 26*d* of isochronous governor 26, to prevent amplifier 36 from going into saturation and thus aids in maintaining the stability of the operational amplifier 36.**

The isochronous governor 26, in the at sea mode, provides at its output terminal **26*d* a signal representative of an input signal at amplifier 36 which input signal is the combination of a first input signal, which is a speed reference voltage, representative of the desired rotational speed of the system, applied to one input 26*b* of isochronous governor 26 and a second input signal, which is a reference voltage proportional to the actual speed of the system applied to a second input 26*c* of said isochronous governor. The output signal at terminal 26*d* is applied to second inputs 18*c* and 18*d* of quarter-square electronic multipliers 18S and 18P, respectively. The quarter-square multipliers 18S and 18P** operate in accordance with the formula $XY = \frac{1}{4}[(x + y)^2 - (x - y)^2]$, where $x$ is one input, $y$ is a second input and $XY$ is the output. Such quarter-square multipliers are well known in the art.

The output signals of quarter-square multipliers 18S and 18P derived at terminal **18*e* and 18*f* are fed to servo drives 28S and 28P, respectively, through first position closed switch contacts A and B of switches 30S and 30P. The servo drives 28S and 28P provide respective commands to a starboard pitch servo 32S and a port pitch servo 32P which servos control the pitch of starboard propeller 34S and port propeller 34P,** respectively.

The propellers 34S and 34P are driven by means of shafts 36S and 36P from a transmission 38 which is suitably coupled to prime mover 10 in a manner well known in the art. An electric power generator 40 is also driven from the prime mover 10 through transmission 38.

When the control system is performing in the at sea mode, the prime mover 10 is operated at a predetermined power level set through two quadrant cubic function generators 22S, 22P, amplifier 24, turbine control system 14 and fuel system 12 in a manner well known in the art.

In order to avoid substantial changes in the predetermined rotational speed of the connected system due to variation of load conditions at propellers 34S and for 34P, the pitch of said propellers is varied in accordance with the commands at the inputs to the quarter-square electronic multipliers 18S and 18P obtained from propulsion controls 16S and 16P each combined with the signal output from isochronous governor 26, said output at **26*d* being related to the inputs thereto at 26*c* and 26*b*** by the transfer function:

$$\frac{\text{OUT}}{\text{REF} - N} = K\frac{1 + Ts}{Ts}$$

where *REF* is the speed reference voltage applied to terminal **26*c*,** *N* is a voltage proportionate to the actual connected system speed applied to terminal **26*b*,** *K* and *T* are predetermined constants and *s* is the Laplace operator.

Figure 2:
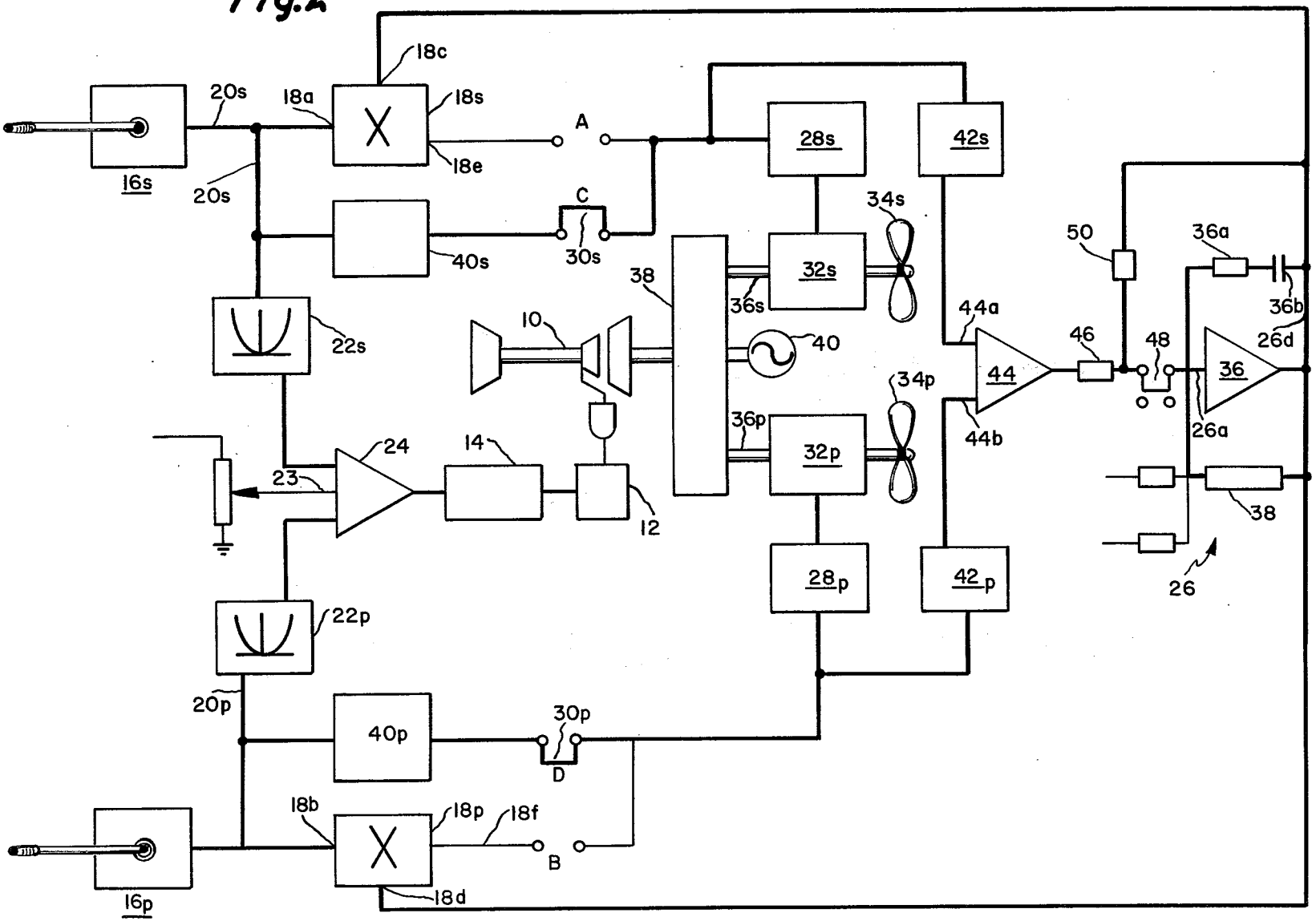
FIG. 2 is a diagram of the circuit of the invention for use with a prime mover of a vessel operating in the maneuvering mode, with heavy lines indicating the components in said mode.

Referring to FIG. 2, the circuit of the control system of the invention is shown as the same as used in the at sea mode. It will be noted that the circuit for the fuel control of prime mover 10 is substantially the same with the proviso that in accordance with mmeans well known in the art, the speed of the prime mover 10 is variable as a function of the load, and may vary or float between 50 and 105% of the speed of the same in the at sea mode.

Starboard and port manual control 16S and 16P remain connected to quarter-square multipliers 18S and 18P and are further connected to direct starboard and port pitch controls 40S and 40P. The output of multipliers 18S and 18P are disconnected from the servo drives 28S and 28P through the change in position of switches 30S and 30P from first position closed switches A and B to second position closed switches C and D which connects the servo drives 28S and 28P to direct pitch controls 40S and 40P, respectively. The control of the propellers 34S and 34P is thus directly related to the input at port and starboard manual controls 16S and 16P. One exemplary system for controlling the pitch of the propellers, when in the maneuvering mode, may be gained from reference to U.S. Pat. No. 3,639,076 issued on Feb. 1, 1972 to William I. Rowen and assigned to the assignee of this application.

In order to provide for an orderly transition from the maneuvering mode to the at sea mode, the signal at inputs to servo drives 28S and 28P is also fed to absolute value circuits 42S and 42P, which are well known in the art and which provide output signals of a given polarity regardless of input polarity, to the inputs **44*a* and 44*b* of operational amplifier 44. The output of amplifier 44 is fed through a resistor 46 and a switch 48 to input 26*a* which is the input to amplifier 36. A further resistor 50 is connected between the output terminal 26*d* and input terminal 26*b* of amplifier 36, as well as across the series resistor-capacitor network 36*a*, 36*b* respectively changing the characteristics of the isochronous governor 26 to that of a proportional amplifier. The output of proportional amplifier 36 is fed to an input of quarter-square multipliers 18S and 18P and combined in the respective quarter-square multipliers with signals representative of the positions set in manual starboard control 16S and manual port control 16P thus making the output of quarter-square electronic multipliers 18S and 18P track the positions of propellers 34S and 34P. In going from the maneuvering mode to the at sea mode through transferring switches 30S and 30P, from the position shown in FIG. 2 to that shown in FIG. 1**, there is a smooth transition because of the foregoing.

DETAILED OPERATION OF THE INVENTION

Heretofore individual components and details of their functions have been described and a brief description of the overall system operation follows.

Starting with a description of operation of a vessel in the at sea mode, and referring to FIG. 1, manual controls for the port and starboard desired propeller pitches are placed in the control system by setting port and starboard manual controls 16S and 16P respectively. The foregoing settings provide signals to the fuel control portion of the propulsion system through starboard and port cubic function generators 22S and 22P and amplifier 24, said signals being combined at the input of amplifier 24 with a signal representative of the power requirements of the ships electrical power system. The fuel control of the prime mover or gas turbine is thus set as a function of the combined propulsion and electrical power requirements to provide a fixed power output of the turbine.

Recognizing that while a vessel is under way, there may be factors which will tend to vary the load placed upon either one or both of the propellers of the vessel, and desiring that the total power absorbed by said propellers remain substantially constant, consonant with the proportion of the settings on the starboard and port manual controls, signals from the starboard and port manual controls are combined with a signal from isochronous governor 26 in quarter-square multipliers 18S and 18P repectively. Isochronous governor 26 is much like a governor whose purpose is to maintain the speed of the turbine or prime mover constant. The inputs to isochronous governor comprise a reference signal representative of the desired system rotational speed applied to input **26*b* and a signal representative of the monitored system rotational speed applied to input 26*c*. Changes in the signal representative of the system rotational speed are reflected in the output of isochronous governor 26 and since the output of the isochronous governor 26 is fed to one input of quarter-square multipliers 18S and 18P respectively, the output of quarter-square multipliers 18S and 18P are affected with servo drives 28S and 28P being adjusted to proportionally change the pitch of propellers 34S and 34P** in a sense whereby the load on said propellers is adjusted to bring the system load back to a value which is required to keep the system rotational speed at the desired predetermined rotational speed.

When it is desired to go from the at sea mode to the maneuvering mode, switches 30S, 30P as well as switch 48 are positioned as shown in FIG. 2. In the maneuvering mode control of the fuel to the turbine utilizes the same circuitry as previously described, however rotational speed of the system may vary within predetermined limits. Control of propeller pitch of both starboard and port propellers is exercised directly by the starboard and port manual controls 18S and 16P respectively, in a manner well known in the art. The position of the pitch of each of the propellers at any given time is fed to absolute value circuits 42S and 42P and thence to amplifier 44 and 36 serially and back to quarter-square multipliers 18S and 18P. This circuitry permits the respective quarter-square multipliers to track the propeller pitch wihout affecting propeller pitch but being in condition to pick up the existing propeller pitch when the circuit is turned from the maneuvering mode to the at sea mode.

While the multipliers 18S and 18P have been depicted and described as being quarter-square multipliers, it will be understood by those skilled in the art that other means of performing electronic multiplication of electrical signals may be employed. In addition, while the function generators 22S and 22P have been depicted and described as being cubic in nature, and such is the preferred embodiment, it will be understood that in some vessel applications, other exponential function generators may be effectively employed.

Accordingly, while there has been shown one embodiment of the invention, it is to be understood that various modifications will occur to those skilled in the art, and it is intended that the appended claims cover such modifications as fall within the spirit and scope of the invention.

What is claimed as new and desired to be secured by Letters Patent of the United States is:

1. A control system for a variable pitch twin propeller propulsion system of a vessel including a port propeller and a starboard propeller, both of said propellers being driven through a transmission by a single prime mover operating at a predetermiend substantially fixed rotational speed and wherein said port and starboard propellers are to present a substantially fixed load to said prime mover in a first mode, said control system comprising:

an isochronous governor for generating a signal representative of a deviation from said predetermined system fixed rotational speed, port manual control means for generating a signal representative of a setting of the desired pitch for said port propeller, and starboard manual control means for generating a signal representative of a setting of the desired pitch for said starboard propeller, port servo means for setting the pitch of said port propeller, said port servo means being responsive to a first signal for setting the pitch of said port propeller, and said starboard servo means being responsive to a second signal for setting the pitch of said starboard propeller, a port multiplier for applying a first signal to said port servo, and a starboard multiplier for applying a second signal to said starboard servo, each said multiplier having a first input and a second input and an output, means for connecting said signal from said isochronous governor to the first input of said port and starboard multipliers, and means for connecting said signal from said port manual control means to the second input of said port multiplier, and means for connecting said signal from said starboard manual control means to the second input of said starboard multiplier, and means for connecting the output of said port multiplier to the port servo means and means for connecting the output of said starboard multiplier to said starboard servo means.

2. A control system for a variable pitch twin screw propeller propulsion system of a vessel according to claim 1 and including means for switching said control system between a first mode of operation and a second mode of operation.

3. A control system for a variable pitch twin screw propeller propulsion system of a vessel according to claim 2 and wherein said means for switching said control system between a first mode of operation and a second mode of operation includes means for converting said isochronous governor to a proportional amplifier.

4. A control system for a variable pitch twin screw propeller propulsion system of a vessel according to claim 2 and wherein said means for switching said control system between a first mode of operation and a second mode of operation includes means for providing an input signal representative of the port and starboard propeller pitches to the second inputs of said port and starboard multipliers respectively during the operation of said control system in said second mode.

5. A control system for a variable pitch twin screw propeller propulsion system of a vessel according to claim 4 and wherein said means for providing an input signal representative of the port and starboard propeller pitches includes a port absolute value circuit for monitoring said port propeller pitch and providing a signal representative of said pitch to said proportional amplifier, and a starboard absolute value circuit for monitoring said starboard propeller pitch and providing a signal representative of said pitch to said proportional amplifier, and said proportional amplifier provides an output signal to said first inputs of said port and starboard multipliers.

6. A control system for a variable pitch twin screw propeller propulsion system of a vessel according to claim 1 further characterized in that said port and starboard multipliers are quarter-square multipliers.

* * * * *